US006953888B2

(12) United States Patent
Livshitz et al.

(10) Patent No.: US 6,953,888 B2
(45) Date of Patent: Oct. 11, 2005

(54) THIN COAXIAL CABLE AND METHOD FOR ITS MANUFACTURE

(76) Inventors: Daniel Livshitz, 38 Yehuda Hanasi Street, Tel-Aviv 69206 (IL); Gabriel Livshitz, 184 Hayarkon Street, Tel-Aviv 63452 (IL)

( * ) Notice: Subject to any disclaimer, the term of this patent is extended or adjusted under 35 U.S.C. 154(b) by 11 days.

(21) Appl. No.: 10/372,105

(22) Filed: Feb. 25, 2003

(65) Prior Publication Data

US 2004/0163833 A1 Aug. 26, 2004

(51) Int. Cl.[7] ..... H01B 11/00

(52) U.S. Cl. ..... 174/28; 174/120 R; 174/121 R; 174/122 G; 174/124 R; 174/106 R

(58) Field of Search ..... 174/28, 120 R, 174/121 R, 122 G, 124 R, 106 R

(56) References Cited

U.S. PATENT DOCUMENTS 3,612,743 A * 10/1971 Angele et al. ..... 174/36

5,369,219 A * 11/1994 Kerns ..... 174/250

FOREIGN PATENT DOCUMENTS

| | | |
|---|---|---|
| JP | 6-187847 | 7/1994 |
| JP | 2000-18013 | 5/2000 |
| JP | 2000-138014 | 5/2002 |

* cited by examiner

*Primary Examiner*—Dean A. Reichard
*Assistant Examiner*—Jinhee Lee
(74) *Attorney, Agent, or Firm*—Browdy and Neimark, P.L.L.C.

(57) ABSTRACT

A thin coaxial cable is provided comprising an inner conductor; an outer conductor being an electroplated conductive metal layer; a thin electrically insulating layer made of a polymeric enamel resin or of glass of at most approximately 15 $\mu$m thickness separating said inner and said outer conductor; said insulating glass or polymeric enamel resin layer is coated with a layer of an adhesion promoting primer material or said insulating polymeric enamel resin layer is coated with a layer of ABS resin, and an electroless plated metal layer is deposited between said primer or ABS resin layer and said electroplated conductive metal layer.

34 Claims, 2 Drawing Sheets

THIN COAXIAL CABLE AND METHOD FOR ITS MANUFACTURE

FIELD OF THE INVENTION

The present invention relates to coaxial cables and more particularly to thin, preferably, very thin coaxial cables, and to methods for their manufacture.

BACKGROUND OF THE INVENTION

Coaxial cables are usually composed of an elongated outer tubular conductor of metal containing a concentrically situated elongated central conductor of metal, both conductors being separated by a layer of an electrically insulating material. The central conductor may be composed of a single wire or bundle or wound wires, also known as litz.

Coaxial cables are used in many areas such as transmission and computer cables, computer networking, video signal transmission, instrumentation cables, broadcast cables, e.g. TV companies between the community antenna and user homes or businesses, telephone companies, medical e.g. ultrasound devices, and lightweight coaxial cables for satellites. For some of these applications, miniature coaxial cables are desired and an upper limit as to the overall thickness of the cable is required. This is particularly important in invasive ultrasound and surgery equipments, where the cables that deliver the information travel through delicate human tissues or organs. For such applications, all components of the coaxial cable should be as thin as possible while meeting the physical as well as electrical requirements necessary for proper shielding to prevent interference and eliminate cross-talking within the pack of cables used.

With most consumer electronic products that use coaxial cables, the shielding layer is made of a braided mesh-like metal layer, that envelopes around the center conducting metal layer, or of aluminum foil, which is laid around or glued to the insulating layer. These structures are not suitable for thin wires due to technological limitations.

For the shielding of thin wires, direct coating of the conducting layer is usually used. The most common techniques employ vacuum deposition of thin aluminum film on the insulating layer, coating the insulating layer with a conductive lacquer, or electroplating a metal layer on the insulating layer. From the alternatives of electroplating metals, electrolytic copper gives the best results in terms of conductivity, solderability, flexibility and long-term environmental resistance. However, for using this technique, it is necessary to ensure good adhesion of the electroplating metal to the insulating layer.

Several attempts have been made in recent years to attend the demand for reducing the diameter of coaxial cables that are used in miniaturized measuring, information handling and information communication equipments. For example, in order to provide a coaxial cable that is strong against bending and is compact, Japanese Patent Application No. 2000-138013, published on May 16, 2000, proposes a coaxial cable with an extruded coating insulator made of fluorinated resin of at least 35$\mu$ thickness on a conductor, an electroless-plated metal layer on the insulator which surface has been treated by a surface-reforming treatment, for example, by excimer laser or chemical treatment, an electroplated metal layer on the electroless-plated metal layer, and a protective covering layer on the outer layer. In order to improve plating adhesion, Japanese Patent Application No. 2000-138014, published on May 16, 2000, proposes a coaxial cable with the same characteristics as the coaxial cable of JP 2000-138013, but further having a thin ABS resin sheath layer applied on the extruded coating fluorinated resin insulator of at least 35$\mu$ thickness that underwent aggressive excimer laser or chemical treatment, said thin ABS resin layer promoting a satisfactory adhesion between the insulator reformed surface and the plated layer. The use of extruded fluorinated resins or extruded polypropylene does not permit to obtain very thin insulator layers, as are needed in coaxial cables for certain applications, particularly for ultrasound equipment for medical purposes.

SUMMARY OF THE INVENTION

It has now been found, according to the present invention, that thin coaxial cables having a very thin insulating layer and a thin high conductive electrolytic shielding layer can be obtained, when the very thin insulating intermediate layer between the inner and outer conductors is made of a dielectric material selected from glass or of a polymeric enamel resin, and said glass or polymeric enamel resin insulating layer is coated with a primer material that promotes adhesion or said polymeric enamel resin insulating layer is coated with an ABS resin layer, wherein said primer adheres to the glass or polymeric resin insulating layer and, at the same time, enables electroplating of adherent conductive metal to the thin glass or polymeric resin insulating layer through an electroless metal plating process. The suitable primer having these characteristics essential for the invention is herein referred to as "adhesion promoting primer". The ABS resin also adheres to the polymeric resin insulating layer and enables electroplating of adherent conductive metal to the thin polymeric resin insulating layer through an electroless metal plating process.

The present invention thus relates to a thin coaxial cable comprising:

an inner conductor;

an outer conductor, being an electroplated conductive metal layer;

a thin electrically insulating layer of at most approximately 15 $\mu$m thickness separating said inner and said outer conductor, wherein said thin insulating layer is made of a polymeric enamel resin; and said polymeric enamel resin insulating layer is coated with a layer of an adhesion promoting primer or of ABS resin, and an electroless plated metal layer is deposited between said primer or ABS resin layer and said electroplated conductive metal layer.

The present invention further relates to a thin coaxial cable comprising:

an inner conductor;

an outer conductor, being an electroplated conductive metal layer;

a thin electrically insulating layer of at most approximately 15 $\mu$m thickness separating said inner and said outer conductor, wherein said thin insulating layer is made of glass; and said glass insulating layer is coated with a layer of an adhesion promoting primer, and an electroless plated metal layer is deposited between said primer layer and said electroplated conductive metal layer.

According to the present invention, thin coaxial cables can be made with an outside diameter as low as of approximately 40–60 $\mu$m thickness. These thin coaxial cables can be used in any application where miniaturized information handling and communication equipment is employed such as, but not limited to, medical devices including invasive ultrasound devices, and as building blocks in neuroscience development for a future use for transfer of signals to organic neural networks.

DETAILED DESCRIPTION OF THE INVENTION

Figure 1:
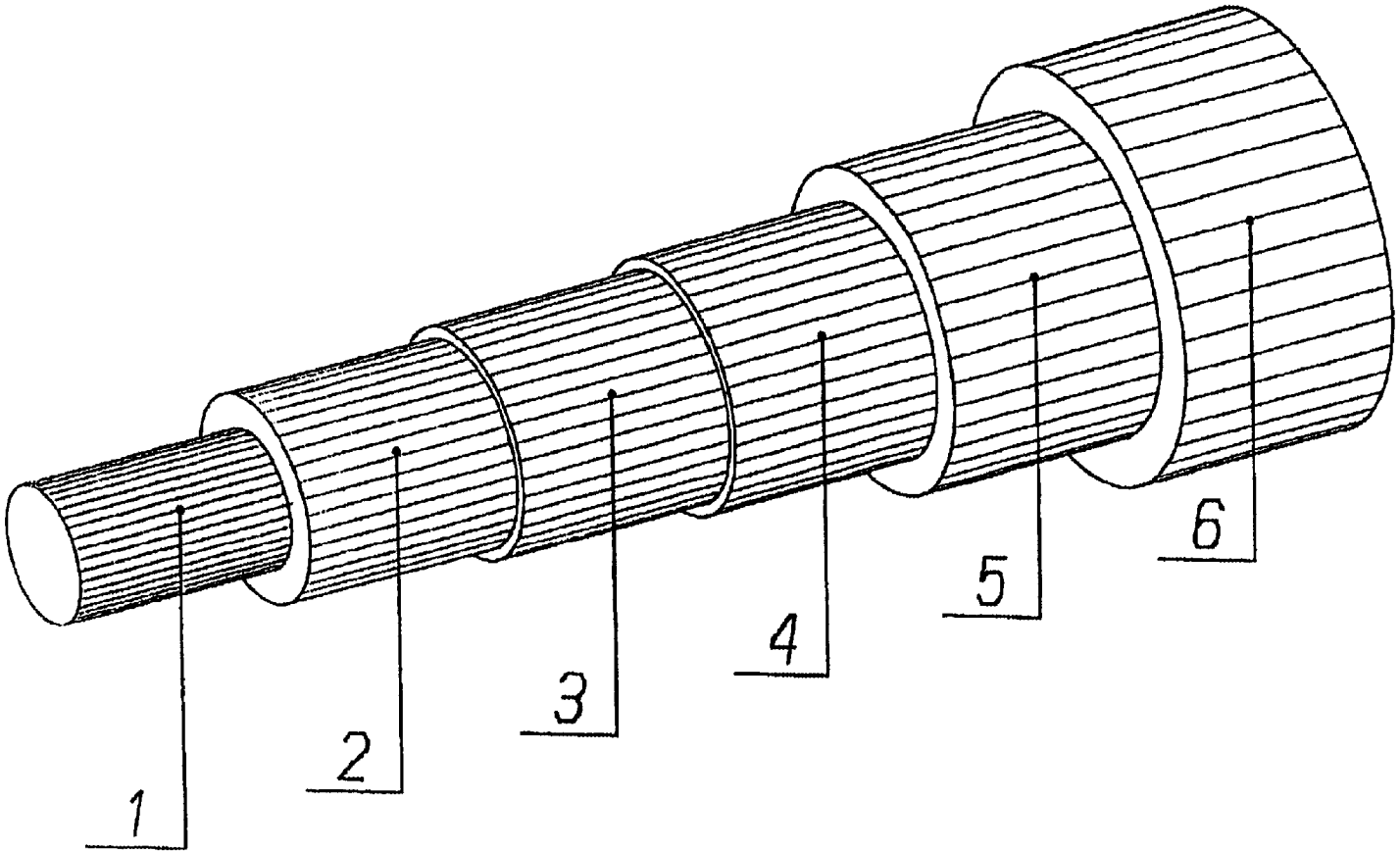
FIG. 1 shows a coaxial cable in accordance with the invention.

FIG. 1 depicts schematically a coaxial cable according to the invention in which on the inner conductor 1 an insulation layer 2 is coated, on which insulation layer a primer or ABS resin layer 3 is applied, followed by an electroless plated metal layer 4, on which an electroplated conductive metal layer 5 is deposited and, optionally, a protective lacquer layer 6 covers that metal layer 5.

Figure 2:
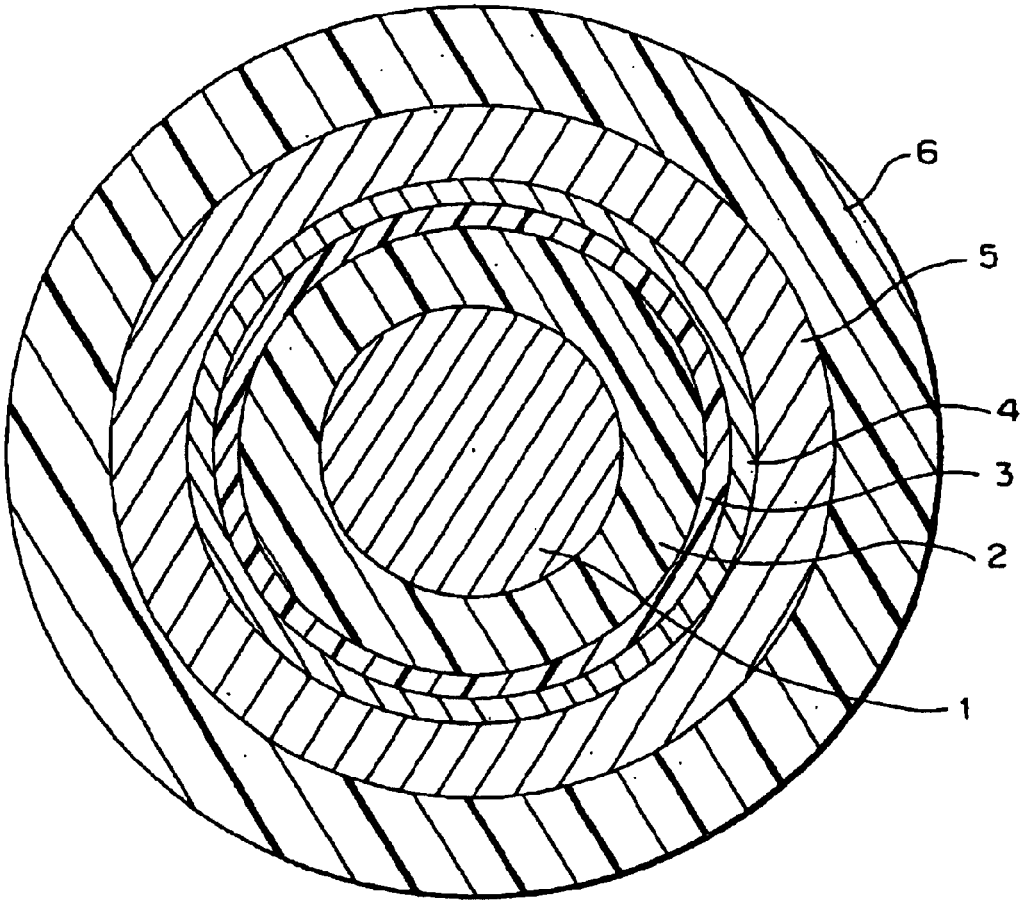
FIG. 2 is a cross-sectional showing of a coaxial cable according to the invention.

FIG. 2 is a cross-section of a coaxial cable of the invention in which the reference numbers 1–6 have the same meaning as in FIG. 1.

The inner or central conductor 1 may be a single wire or a litz wires made of a conductor selected from the group consisting of copper, steel, tin, silver, gold and combinations thereof. Combinations of conductors include, for example, a steel conductor electroplated with copper or tin. Said single wire or each wire of the litz wires is preferably at most approximately 60, more preferably at most 40, most preferably at most 35 $\mu$m thick, but for some applications also a thickness of at most 100 $\mu$m is envisaged by the invention. Said single wire or each wire of the litz wires is preferably at least approximately 2, more preferably at least 5, most preferably at least 20 or 25 $\mu$m thick. Thus, ranges of thickness of said single wire or each wire of the litz wires of approximately 2–5 to 35–60, preferably 2–20 to 35–40, more preferably approximately 20 to 40, and most preferably, approximately 25 to 35 $\mu$m, are encompassed by the present invention. When the insulator is glass, the inner conductor is preferably at most approximately 40 $\mu$m, and may be approximately 2–40, or preferably approximately 2 to 35 $\mu$m thick.

A very thin layer 2 of an electrically insulating material is provided around the inner conductor, either around the single wire or around each of the litz wires. This layer is at most approximately 15 $\mu$m thick and is made of a dielectric material that provides required electrical properties but permits to obtain layers of such a low thickness.

In one embodiment, the dielectric material for making the thin insulating layer 2 is glass. A method for the manufacture of a cable wherein the insulating layer is made of glass comprises melting the inner conductive wire inside molted glass and drawing the molten metal with the molten glass, when the thickness is controlled by the rate at which the molten mass is drawn. Using this method wires with very thin thickness can be obtained, for example the central copper conductor can be 2 to 35 $\mu$m thick, and the glass insulation layer can be approximately 2 to 15, preferably 2 to 10, most preferably 5 or 7.5 $\mu$m thick. Copper wires with a glass insulation layer of such a thickness are also commercially available.

In another embodiment, the dielectric material for making the thin insulating layer 2 is an organic resin such as a polymeric enamel resin known in the art such as, but not limited to, a polyesterimide, a polyamideimide, a polyurethane, or a polyester and the polymeric enamel resin layer is approximately 5 to 15, preferably 7.5 $\mu$m thick. Thin cables coated with such enamel resins with thickness of even below 5 microns are commercially available.

It should be noted in the context of the present invention that the use of known dielectric materials such as extruded polypropylene and extruded fluorinated resins such as PFA, PFTE, FEP, and EFTE as the insulating layer should be avoided, since they are provided on the central conductor by an extrusion technique that cannot produce coatings below a minimum of 50 microns.

The shielding conductive metal layer 5 is made of a conductive metal selected from copper, silver, nickel, gold and combinations thereof, and is designed to have a thickness in the range of approximately 2 to 20, preferably 5 to 10 microns. For some applications, e.g. for a long cable, thicker coating might be needed to provide necessary shielding. This layer 5 should have the best possible conductivity so as to maintain the needed shielding requirement with a minimum thickness. The conductive layer should also be smooth, free of internal stress, and very ductile to allow for bending without breakage or formation of fissures. In addition, in most applications of the coaxial cables, the outer conductor has to be easily soldered for electric grounding purposes.

Taking all these considerations into account, the present invention preferably uses as the outer conductor a copper layer deposited by an electroplating process from a solution containing copper sulfate and sulfuric acid. It was found according to the present invention that the use of alternative shielding materials like conductive lacquers made of dispersed metal powder in organic resins or vacuum-coated aluminum could not meet with some or all of the mentioned requirements.

The coaxial cable of the invention may optionally contain a protective lacquer insulating layer 6 coating the outer conductor layer 5. This protective lacquer layer may be made of a synthetic resin such as polyurethanes, polyesters, polyamides, silicones, PVC or other resins known in the art, and has preferably a thickness in the range of approximately 7–15 microns or more to match working environment i.e. humidity, corrosion, friction, etc.

When fine coaxial cables are used in medical instruments like ultrasound devices, or miniature electronic devices, and fine cables are twisted finding their way into intricate passages, the adhesion between the outer conductive metal shielding layer and the middle insulating layer is of outmost importance.

One of the main objects of the present invention is to provide a coaxial cable in which there is a good adhesion between the high conductive electrolytic outer metal layer and the very thin dielectric layer.

In the current art of coaxial cables, deposition of electroplated metal on dielectric materials requires roughening of the dielectric material layer by aggressive means such as mechanical or chemical means, plasma or excimer laser, to produce undercuts or anchors on the surface of the dielectric material layer. Into these undercuts, a metal layer is deposited through a chemical process known as electroless plating, whereby the undercuts provide a mechanical adhesion between the dielectric and the electroless metal layers. On this electroless metal layer, a thicker metal layer is then electroplated mostly with an electrolytic copper to make the high conductive shielding layer. According to this known in the art procedure, it is the roughening of the dielectric layer that enables adhesion of the conductive shielding layer to the inner cable via the electroless layer.

The roughening processes described above work well when applied to thick layers of dielectric materials such as layers of fluorinated resins or polyolefins, which are mostly made by extrusion techniques. However, for the very thin insulating layers of glass or organic enamels according to the present invention, the roughening processes are not suitable because they would affect their structure in a way such as to cause harm to their integrity or to produce voids which could cause subsequently short-circuits between the inner conductor and the outer electroplated conductive layer.

In order to create surface roughness of thin insulating layers of organic enamels such as polyesterimide-based enamels and the like, to promote the required subsequent adhesion to the conductive outer layer, an aggressive treatment of the surface would be required, including a preliminary swelling stage followed by an oxidation stage, due to the chemical resistance of these materials to oxidizing agents. This treatment would severely affect the thin layer and is thus unsuitable for thin insulating layers of organic enamels according to the present invention.

When the insulating layer is made of glass such as of chemical resistant borosilicate (PYREX®), a high degree of roughening would be required to secure the needed final adhesion. For this purpose, an aggressive fluoride-based treatment or abrasive blasting would have to be used, which would cause pitting and tiny cracks within the very thin glass layer, and therefore would cause short-circuits in the electroplated cable. Thus, the known procedures are unsuitable also for thin insulating glass layers according to the present invention.

In one embodiment, these problems are solved by the present invention whereby the roughening stage of the insulation dielectric materials is eliminated and proper adhesion is achieved by the application of a suitable adhesion promoting primer layer 3, which has the characteristics to form a film with good adhesion properties to the thin dielectric layer and, at the same time, can be electroplated to produce an adherent conductive metal layer through an intermediate electroless metal plating procedure. By this procedure of the present invention, the dielectric insulating layer is not affected with regard to the adhesion to the outer conductor and to the mechanical characteristics, regardless of its thickness, both for organic enamel and for glass insulation.

The suitable adhesion-promoting primers used in the present invention are preferably based on one or more isocyanates and contain a carbon black pigment. Examples of isocyanates that can be used as primers according to the invention in conjunction with carbon black include, but are not limited to aliphatic polyisocyanate, aromatic polyisocyanate, monomeric isocyanate, tris(p-isocyanatophenyl)thiophosphate, diphenylmethane diisocyanate (MDI), hexamethylene diisocianate (HDI), 2,4-toluene diisocianate, and their combinations. The primers are dissolved in solvents such as ethyl acetate, n-butyl acetate, butanone, 2-methoxy-1-methylethyl acetate, 1-methoxy-2-propyl acetate, xylene, methyl ether acetate, carbon tetrachloride, or combinations thereof. The solution of the primers will contain a carbon black pigment, preferably at a ratio of 3–10%. These materials are commercially available. In addition, the solution may also contain polymers and resins which are soluble in these solvents and may be used to modify film characteristics.

According to the present invention, the primers are applied onto the glass or organic enamel resin insulating layer of the cable by dipping, spraying, or brushing and then are air or oven dried to provide a very thin, even and adherent film. The dry film is then submitted to a mild etching procedure by treatment for 1–2 minutes in an etch solution containing chromic acid, sulfuric acid and a wetting agent. This mild etch solution exposes a delicate micropore structure on the very upper surface of the primer film without affecting its consistency or much of its surface finish. This micropore structure was found according to the present invention to provide the necessary anchor for the desired adhesion of subsequent layers. It was also found that there was no penetration of voids from the metal shielding layer 5 through the primer layer 3 and insulating layer 2 into the inner conductor 1, thus not causing short circuits in the final produced coaxial cable. The primer layer has preferably a thickness of approximately 2 to 10, more preferably, 3 to 8 $\mu$m.

According to the procedure of the present invention, after the mild etching cycle of the primer layer deposited on the insulating layer, the cable is further dipped in a catalyst solution containing palladium and stannous salts in a colloidal form, followed by an acidic accelerator solution, which may contain also palladium chloride. In the next step, the cable goes through electroless nickel and/or electroless copper plating by treatment with a solution which deposits a conductive nickel and/or copper thin film 4 of approximately 0.25–3 microns, by chemical deposition.

On the electroless conductive nickel and/or copper layer 4, an electrolytic conductive metal outer layer 5 is deposited by electroplating. The conductive metal may be selected from copper, silver, nickel, tin and gold or combinations thereof, and the layer has a thickness of 2 to 10, preferably 5 to 10 $\mu$m. In one preferred embodiment, the conductive metal is copper. The cable is preferably electroplated in an acid solution containing copper sulfate and sulfuric acid to produce the outer high conductive copper layer 5. It was found as shown hereinafter in the examples that the copper conductive layer thus formed had a consistent good surface finish and was ductile enough so that, when forming a loop of about 5 mm, no breakage of the copper layer occurred. The electroplated copper thus formed also lent itself to convenient soldering techniques as opposed to other shielding materials such as vacuum deposited aluminum or conductive lacquers made of metal powders dispersion in an organic matrix.

In another embodiment, the state of the art problems are solved by the present invention whereby the roughening stage of the insulation dielectric polymeric enamel resin material is eliminated and proper adhesion is achieved by the application of an ABS resin layer 3 which, similarly to the above-described primer, has the characteristics to form a film with good adhesion properties to a thin organic resin enamel dielectric layer without affecting said dielectric insulating layer and, at the same time, can be electroplated to produce an adherent conductive metal layer through an intermediate electroless metal plating procedure.

It was thus found that when coating a thin cable 1 having a thin organic enamel layer 2 of the materials mentioned above with a varnish of ABS plastic material, instead of with a primer material, and treating the dried layer with a chromic/sulfuric mild etch solution followed by the plating cycles the same as for the primer material, there was no formation of blisters or any separation of the ABS layer from the insulating organic enamel layer, and the final electroplated copper thus obtained had sufficient elasticity and integrity for the applications of the cable, particularly in ultrasound equipment. Such separations and blisters would have occurred if this same procedure would have been applied to extruded fluorinated resins or polyolefin resins which were not treated by any prior roughening method.

In one further embodiment, the outer conductive metal layer 5 can optionally be coated with a protective lacquer layer 6 by methods known in the art. The optional external protective coating or jacket may be made over single or stranded shielded wires as well as over packed shielded wires. The protective lacquer can be chosen from the various lacquer types known in the art such as polyesters, silicones and polyurethanes, including those which cure by U.V activation. The lacquer material and the thickness of the layer will be determined by the surroundings under which the coaxial cable will be used.

The methods of manufacture of the present invention described above for coaxial cables containing a single inner conductor wire can be applied as well as to a litz of wires, in which case the primer layer is applied onto the whole insulated litz wires, followed by the same steps for deposition of the additional layers as described above for a single wire.

Thus, in one embodiment, the present invention provides a method of manufacturing a coaxial cable, comprising:

(i) providing an inner conductor which is a single wire or litz wires;

(ii) insulating said inner conductor with an electrically insulating layer of at most approximately 15 $\mu$m thickness of a dielectric material consisting of a polymeric enamel resin;

(iii) coating said insulating polymeric enamel resin layer with a layer of an adhesion promoting primer material;

(iv) drying said layer of (iii) to provide a very thin adherent film;

(v) submitting the dry film of (iv) to a mild etching treatment;

(vi) depositing a metal layer by electroless plating over said etched primer layer of (v); and (vii) electroplating a conductive metal outer layer on the electroless plated metal layer obtained in (vi).

In another embodiment, the present invention provides a method of manufacturing a coaxial cable, comprising:

(i) providing an inner conductor which is a single wire or litz wires;

(ii) insulating said inner conductor with an electrically insulating layer of at most approximately 15 $\mu$m thickness of a dielectric material consisting of a polymeric enamel resin;

(iii) coating said insulating polymeric enamel resin layer with a layer of an ABS resin;

(iv) drying said layer of (iii) to provide a very thin adherent film;

(v) submitting the dry film of (iv) to a mild etching treatment;

(vi) depositing a metal layer by electroless plating over said etched ABS resin layer of (v); and (vii) electroplating a conductive metal outer layer on the electroless plated metal layer obtained in (vi).

In a further embodiment, the present invention provides a method of manufacturing a coaxial cable, comprising:

(i) providing an inner conductor which is a single wire or litz wires;

(ii) insulating said inner conductor with an electrically insulating layer of at most approximately 15 $\mu$m thickness of a dielectric material consisting of glass;

(iii) coating said insulating glass layer of (ii) with a layer of an adhesion promoting primer material;

(iv) drying said layer of (iii) to provide a very thin adherent film of said primer layer;

(v) submitting the dry film of said primer layer obtained in (iv) to a mild etching procedure;

(vi) depositing a metal layer by electroless plating over said etched primer layer obtained in (v); and (vii) electroplating a conductive metal outer layer on the electroless plated metal layer obtained in (vi).

In still another embodiment, the method of the present invention further comprises coating said conductive metal outer layer obtained in any of the steps (vii) above with a protective lacquer layer.

In one preferred embodiment, the invention provides a very thin coaxial cable having a solid single copper wire conductor or twisted copper wires (litz) 1 of 20 $\mu$m diameter, with insulating material 2 made of glass to produce an insulator layer 5 to 7.5 $\mu$m thick, further coated on this insulator layer an adhesion promoter isocyanate-based primer layer 3 of 2 to 10 $\mu$m, over said primer layer a layer 4 of 0.25 to 3 $\mu$m thickness of copper deposited by electroless plating, and on that said electroless copper layer an electroplated conductive metallic copper layer 5 that is 5 to 10 $\mu$m thick. This coaxial cable may have optionally an outer layer 6 of a protective lacquer.

In another preferred embodiment, the invention provides a very thin coaxial cable having a solid single copper wire conductor or twisted copper wires (litz) 1 of 35 $\mu$m external diameter, with a lacquered coated organic enamel layer 2 made of polyesterimide resin to produce an insulator layer of 7.5 $\mu$m thickness, and further coated on this insulator an adhesion promoter isocyanate-based primer layer 3 of 1 to 10 $\mu$m thickness, on which primer surface is further deposited a metallic layer 4 of 0.25 to 3 $\mu$m thickness made by electroless copper plating, and on said electroless copper layer an electroplated conductive copper layer 5 of 2 to 10 $\mu$m thickness with, optionally, an outer protective lacquer layer 6.

In a further preferred embodiment, the invention provides a very thin coaxial cable having a solid single copper wire conductor or twisted copper wires (litz) 1 of 35 $\mu$m external diameter, with a lacquered coated organic enamel layer 2 made of polyesterimide resin to produce an insulator layer of 7.5 $\mu$m thickness, and further coated on this insulator an ABS resin layer 3 of 2 to 10 $\mu$m thickness, on which primer surface is further deposited a metallic layer 4 of 0.25 to 3 $\mu$m thickness made by electroless copper plating, and on said electroless copper layer an electroplated conductive copper layer 5 of 2 to 10 $\mu$m thickness with, optionally, an outer protective lacquer layer 6.

The invention will now be illustrated by the following non-limitative examples.

EXAMPLE 1

A cable made of a copper conductor of 20 $\mu$m diameter and with a glass insulation layer having a thickness of 5 micron, was coated with the isocyanate-based adhesion promoter Sika®-Primer 206 G+P (Sika Corporation, Mich., USA). This primer material consists of a solvent-based polyisocyanate composition comprising aliphatic polyisocyanate and tris(p-isocyanatophenyl)thiophosphate in the solvents n-butyl acetate, ethyl acetate and 2-methoxy-1-methylethyl acetate, and 5–10% carbon black. The primer was allowed to dry in air and the approximately 5 $\mu$m thick layer was then treated for 1.5 min. in a solution containing 360 gr/l chromic acid and 180 cc/l sulfuric acid. After rinsing, the cable was immersed in an acidic solution of palladium/stannous salts (Mactivate-10, MacDermid Inc., CT, USA), rinsed, immersed in an acidic solution of hydrochloric acid, rinsed again and coated with a conductive nickel layer in an ammoniacal electroless nickel solution containing nickel sulfate, sodium hypophosphite, sodium citrate and ammonium chloride at a pH of 8.5. After rinsing, the cable was electroplated in an acidic copper solution containing 200 gr/l copper sulfate, 60 gr/l sulfuric acid and 50 p.p.m of $Cl^-$ as an anion, at a current density of 2 amp/sqdc to a thickness of layer 5 of approximately 5 micron. To test the elasticity of the copper shielding layer along the cable, a loop of 5 mm was formed and checked under a magnifying glass. There was no formation of cracks or fissures on the copper layer.

EXAMPLE 2

A cable made of a copper conductor of 35 $\mu$m diameter and with an organic enamel insulation layer made of polyesterimide having a thickness of 7.5 micron, was coated with the isocyanate-based adhesion promoter Sika®-Primer 209 (Sika Corporation, Mich., USA). This primer material consists of a solvent-based polyisocianate composition comprising diphenylmethanediisocyanate and the solvents n-butyl acetate, ethyl acetate and butanone, and 5–10% carbon black.

The primer layer was allowed to dry in air and then treated for 2 min. in a solution containing 360 gr/l chromic acid and 180 cc/l sulfuric acid. Further treatment of the cable was in the same sequence as described in Example 1 above. To test the elasticity of the copper shielding along the cable, a loop of 5 mm was formed and checked under a magnifying glass. There was no formation of cracks or fissures on the copper layer.

EXAMPLE 3

A cable made of a copper conductor of 35 $\mu$m diameter and with a organic enamel insulation made of polyesterimide having a thickness of 7.5 $\mu$m, was coated with a varnish made by dissolving an ABS plastic resin (General Electric) in butanone. The varnish was allowed to dry in air and then treated for 2 min in a solution containing 360 gr/l chromic acid and 180 cc/l sulfuric acid. Further treatment of the cable was in the same sequence as described in Example 1 above. To test the elasticity of the copper shielding along the cable, a loop of 5 mm was formed and checked under a magnifying glass. There was no formation of cracks or fissures on the copper layer.

What is claimed is:

1. A thin coaxial cable comprising:

an inner conductor;

an outer conductor, being an electroplated conductive metal layer;

a thin electrically insulating layer made of a polymeric enamel resin of at most approximately 15 $\mu$m thickness separating said inner and said outer conductor; and said insulating polymeric enamel resin layer is coated with an etched layer of an adhesion promoting primer or of ABS resin, and an electroless plated metal layer is deposited between said primer or ABS resin layer and said electroplated conductive metal layer.

2. A thin coaxial cable as claimed in claim 1 wherein said insulating polymeric enamel resin layer is coated with said layer of the adhesion promoting primer.

3. A thin coaxial cable as claimed in claim 1 wherein said insulating polymeric enamel resin layer is coated with the layer of ABS resin.

4. A thin coaxial cable as claimed in claim 1 wherein said inner conductor is a single wire or litz wires made of a conductor selected from the group consisting of copper, steel, tin, silver, gold and combinations thereof, and said single wire or each wire of the litz wires is at most approximately 60 $\mu$m thick.

5. A thin coaxial cable as claimed in claim 4 wherein said single wire or each wire of the litz wires is at least approximately 2 $\mu$m thick.

6. A thin coaxial cable as claimed in claim 5 wherein said inner conductor is a single copper wire or litz copper wires and said single copper wire or each wire of the copper litz wires is approximately 25 to 35 $\mu$m thick.

7. A method of manufacturing a coaxial cable as claimed in claim 1, comprising:

(i) providing the inner conductor which is a single wire or litz wires;

(ii) insulating said inner conductor with the electrically insulating layer of at most approximately 15 $\mu$m thickness of a dielectric material consisting of the polymeric enamel resin;

(iii) coating said insulating polymeric enamel resin layer with said layer of the adhesion promoting primer material;

(iv) drying said layer of the primer to provide a very thin adherent film;

(v) submitting the dry film of the primer layer to a mild etching treatment;

(vi) depositing the metal layer by electroless plating over said etched primer layer; and (vii) electroplating the conductive metal outer layer on the electroless plated metal layer.

8. A method as claimed in claim 7 further comprising coating said conductive metal outer layer with a protective lacquer layer.

9. A method as claimed in claim 8 further comprising coating said conductive metal outer layer with a protective lacquer layer.

10. A method of manufacturing a coaxial cable as claimed in claim 1, comprising:

(i) providing the inner conductor which is a single wire or litz wires;

(ii) insulating said inner conductor with the electrically insulating layer of at most approximately 15 $\mu$m thickness of a dielectric material consisting of the polymeric enamel resin;

(iii) coating said insulating polymeric enamel resin layer with said layer of the ABS resin;

(iv) drying said layer of the ABS resin to provide a very thin adherent film;

(v) submitting the dry film of the ABS resin layer to a mild etching treatment;

(vi) depositing the metal layer by electroless plating over said etched ABS resin layer; and (vii) electroplating a conductive metal outer layer on the electroless plated metal layer.

11. A thin coaxial cable as claimed in claim 1 wherein said outer conductor is the electroplated conductive metal layer, said conductive metal is selected from the group consisting of copper, silver, nickel, gold and combinations thereof, and said electroplated conductive metal layer is approximately 2 to 20 $\mu$m thick.

12. A thin coaxial cable as claimed in claim 11 wherein said outer conductor is an electroplated conductive copper layer that is approximately 5 to 10 $\mu$m thick.

13. A thin coaxial cable as claimed in claim 1 further comprising a protective lacquer layer surrounding said outer conductor layer.

14. A thin coaxial cable as claimed in claim 1 wherein said electroless plated metal layer is made of at least one of copper and nickel and is approximately 0.25 to 3 μm thick.

15. A thin coaxial cable as claimed in claim 1 wherein said insulating layer is approximately 5 to 15 μm thick and is made of the polymeric enamel resin selected from the group consisting of polyesterimides, polyamideimides, polyurethanes and polyesters.

16. A thin coaxial cable as claimed in claim 15 wherein said polymeric enamel resin is a polyesterimide.

17. A thin coaxial cable as claimed in claim 15 wherein said insulating polymeric enamel resin layer is coated with said layer of the adhesion promoting primer based on one or more isocyanates and containing carbon black pigment.

18. A thin coaxial cable as claimed in claim 17 wherein said primer layer is approximately 2 to 10 μm thick.

19. A thin coaxial cable as claimed in claim 17 wherein said one or more isocyanates are selected from the group consisting of aliphatic polyisocyanate, aromatic polyisocyanate, monomeric isocyanate, tris(p-isocyanatophenyl) thiophosphate, diphenylmethane diisocyanate (MDI), hexamethylene diisocianate (HDI), 2, 4-toluene diisocianate, and their combinations.

20. A thin coaxial cable as claimed in claim 1 wherein said insulating polymeric enamel resin layer is coated with the ABS resin layer.

21. A thin coaxial cable comprising:

an inner conductor;

an outer conductor, being an electroplated conductive metal layer;

a thin electrically insulating layer made of glass of at most approximately 15 μm thickness separating said inner and said outer conductor; and said insulating glass layer is coated with an etched layer of an adhesion promoting primer, and an electroless plated metal layer is deposited between said primer layer and said electroplated conductive metal layer.

22. A thin coaxial cable as claimed in claim 21 wherein said glass-insulated inner conductor is a single wire or litz wires made of a conductor selected from the group consisting of copper, steel, tin, silver, gold and combinations thereof, and said single wire or each wire of the litz wires is at most approximately 40 μm thick.

23. A thin coaxial cable as claimed in claim 22 wherein said single wire or each wire of the litz wires is approximately 2 to 40 μm thick.

24. A thin coaxial cable as claimed in claim 23 wherein said inner conductor is a single copper wire or litz copper wires and said single copper wire or each wire of the litz copper wires is approximately 2 to 20 μm thick.

25. A thin coaxial cable as claimed in claim 21 wherein said insulating glass layer is approximately 2 to 15 μm thick.

26. A thin coaxial cable as claimed in claim 25 wherein said insulating glass layer is coated with said layer of the adhesion promoting primer based on one or more isocyanates and containing carbon black pigment.

27. A thin coaxial cable as claimed in claim 26 wherein said primer layer is approximately 2 to 10 μm thick.

28. A thin coaxial cable as claimed in claim 26 wherein said one or more isocyanates are selected from the group consisting of aliphatic polyisocyanate, aromatic polyisocyanate, monomeric isocyanate, tris(p-isocyanatophenyl)thiophosphate, diphenylmethane diisocyanate (MDI), hexamethylene diisocianate (HDI), 2,4-toluene diisocianate and their combinations.

29. A thin coaxial cable as claimed in claim 21 wherein said outer conductor is the electroplated conductive metal layer, said conductive metal is selected from the group consisting of copper, silver, nickel, gold and combinations thereof, and said electroplated conductive metal layer is approximately 2 to 20 μm thick.

30. A thin coaxial cable as claimed in claim 29 wherein said outer conductor is an electroplated conductive copper layer that is approximately 5 to 10 μm thick.

31. A thin coaxial cable as claimed in claim 21 wherein said electroless plated metal layer is made of at least one of copper and nickel and is approximately 0.25 to 3 μm thick.

32. A thin coaxial cable as claimed in claim 21 further comprising a protective lacquer layer surrounding said outer conductor layer.

33. A method of manufacturing a coaxial cable as claimed in claim 21 comprising:

(i) providing the inner conductor which is a single or a litz wire;

(ii) insulating said inner conductor with the electrically insulating layer of at most approximately 15 μm thickness of a dielectric material consisting of glass;

(iii) coating said insulating glass layer with a layer of the adhesion promoting primer material;

(iv) drying said layer of the primer to provide a very thin adherent film of said primer layer;

(v) submitting the dry film of said primer layer obtained to a mild etching procedure;

(vi) depositing the metal layer by electroless plating over said etched primer layer; and (vii) electroplating the conductive metal outer layer on the electroless plated metal layer.

34. A method as claimed in claim 33 further comprising coating said conductive metal outer layer with a protective lacquer layer.

* * * * *